US006470316B1

(12) United States Patent
Chihara

(10) Patent No.: US 6,470,316 B1
(45) Date of Patent: Oct. 22, 2002

(54) SPEECH SYNTHESIS APPARATUS HAVING PROSODY GENERATOR WITH USER-SET SPEECH-RATE- OR ADJUSTED PHONEME-DURATION-DEPENDENT SELECTIVE VOWEL DEVOICING

(75) Inventor: Keiichi Chihara, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/518,275

(22) Filed: Mar. 3, 2000

(30) Foreign Application Priority Data

Apr. 23, 1999 (JP) ..... 11-116263

(51) Int. Cl.[7] ..... G10L 13/08
(52) U.S. Cl. ..... 704/267; 704/260
(58) Field of Search ..... 704/260, 267

(56) References Cited

U.S. PATENT DOCUMENTS

| | | | | | |
|---|---|---|---|---|---|
| 5,133,010 | A | * | 7/1992 | Borth et al. | 704/264 |
| 5,384,893 | A | * | 1/1995 | Hutchins | 704/267 |
| 5,781,886 | A | * | 7/1998 | Tsujiuchi | 704/275 |
| 5,903,867 | A | * | 5/1999 | Watari et al. | 704/270 |
| 6,101,470 | A | * | 8/2000 | Eide et al. | 704/260 |
| 6,161,093 | A | * | 12/2000 | Watari et al. | 704/270 |
| 6,185,533 | B1 | * | 2/2001 | Holm et al. | 704/267 |
| 6,240,384 | B1 | * | 5/2001 | Kagoshima et al. | 704/220 |
| 6,330,538 | B1 | * | 12/2001 | Breen | 704/260 |
| 6,366,883 | B1 | * | 4/2002 | Campbell et al. | 704/260 |

FOREIGN PATENT DOCUMENTS

JP 11095796 4/1999

OTHER PUBLICATIONS

"Speech Synthesis By Rule Based on VCV Waveform Synthesis Units" Koyama et al., Technical Report of IEICE SP96–8 (May 1996),. pp. 53–60.

"Chatr: a multi–lingual speech re–sequencing synthesis system" Campbell et al., Technical Report of IEICE SP96–7 (May 1996) pp. 45–52.

* cited by examiner

*Primary Examiner*—Tālivaldis Ivars Šmits
(74) *Attorney, Agent, or Firm*—Venable; Robert J. Frank

(57) ABSTRACT

The speech synthesis apparatus according to the present invention includes a text analyzer operable to generate a phonetic and prosodic symbol string from text information of an input text; a word dictionary storing a reading and accent of a word; a voice segment dictionary storing a phoneme that is a basic unit of speech; a prosody generator operable to generate synthesizing parameters including at least a phoneme, a duration of the phoneme and a fundamental frequency for the phonetic and prosodic symbol string, the prosody generator including a vowel devoicing determining means operable to determine whether or not a vowel devoicing process is to be performed and a duration modifying means operable to modify the duration of the phoneme depending on a speech rate set by a user, the vowel devoicing determining means determining that the vowel devoicing process is not performed when the set speech rate is slower than a predetermined rate; and a waveform generator operable to generate a synthesized waveform by making waveform overlap-adding referring to the synthesizing parameters generated by the prosody generator and the voice segment dictionary.

7 Claims, 6 Drawing Sheets

SPEECH SYNTHESIS APPARATUS HAVING PROSODY GENERATOR WITH USER-SET SPEECH-RATE- OR ADJUSTED PHONEME-DURATION-DEPENDENT SELECTIVE VOWEL DEVOICING

BACKGROUND OF THE INVENTION

1. Field of the Invention

The present invention relates to a speech synthesis apparatus that synthesizes a given speech based on rules, in particular to a speech synthesis apparatus in which control of the duration of a phoneme when a vowel is devoiced is improved using a text-to-speech conversion technique that outputs as speech a mixed sentence including Chinese characters (called Kanji) and Japanese syllabary (Kana) used in our daily reading and writing.

2. Description of the Related Art

According to the text-to-speech conversion technique, Kanji and Kana characters used in our daily reading and writing are input and are then converted into speech to be output. Using this technique, there is no limitation on vocabulary to be output. Thus, the text-to-speech conversion technique is expected to be applied to various technical fields as an alternative technique to recording-reproducing speech synthesis.

When Kanji and Kana characters used in our daily reading and writing are input to a conventional speech synthesis apparatus, a text analysis module included therein generates a string of phonetic and prosodic symbols (hereinafter, referred to as an intermediate language) from the character information. The intermediate language describes how to read the input sentence, accents, intonation and the like as a character string. A prosody generation module then determines synthesizing parameters from the intermediate language generated by the text analysis module. The synthesizing parameters include the pattern of phoneme, the duration of the phoneme and the fundamental frequency (pitch of voice, hereinafter simply referred to as pitch) and the like. The synthesizing parameters determined are output to a speech generation module. The speech generation module generates a synthesized waveform by referring to the various synthesizing parameters generated in the prosody generation module and a voice segment dictionary in which phonemes are stored, and then outputs synthesized sound through a speaker.

Next, a conventional process conducted by the prosody generation module is described in detail. The conventional prosody generation module includes an intermediate language analysis module, a pitch contour generation module, a devoicing determination module, a phoneme power determination module, a phoneme duration calculation module and a duration modification module.

The intermediate language input to the prosody generation module is a string of phonetic characters with the position of an accent, the position of a pause or the like indicated. From this string, parameters (hereinafter, referred to as a pitch pattern) required for generating a waveform such as time-variant change of the pitch, duration of each phoneme (hereinafter, referred to as a phoneme duration), and a power of speech (hereinafter, referred to as waveform-generating parameters), are determined. The intermediate language input is subjected to analysis of the character string in the intermediate language analysis module. In the analysis, a word-boundary is determined based on a symbol indicating a word's end in the intermediate language, and a mora position of an accent nucleus is obtained based on an accent symbol.

The accent nucleus is a position at which the accent falls. A word having an accent nucleus at the first mora is referred to as a word of accent type one while a word having an accent nucleus at the n-th mora is referred to as a word of accent type n. These words are referred to an accented word. On the other hand, a word having no accent nucleus (for example, "shin-bun" and "pasokon", which mean a newspaper and a personal computer in Japanese, respectively) is referred to as a word of accent type zero or an unaccented word.

The pitch contour generation module determines a parameter for each response function based on a phrase symbol, the accent symbol and the like described in the intermediate language. In addition, if the intonation (the magnitude of the intonation) or an entire voice pitch is set by a user, the pitch contour generation module modifies the magnitude of a phrase command and/or that of an accent command in accordance with the user's setting.

The devoicing determination module determines whether or not a vowel is to be devoiced based on a phonetic symbol and the accent symbol in the intermediate language. The vowel devoicing determination module then sends the determination result to the phoneme power determination module and the phoneme duration calculation module. Devoicing the vowel will be described in detail later.

The phoneme duration calculation module calculates the duration of each phoneme from the phonetic character string and sends the calculation result to the duration modification module. The phoneme duration is calculated by using rules or a statistical analysis such as Quantification theory (type one), depending on the type of the adjacent phoneme. In a case where the user sets a speech rate, the duration modification module linearly stretches or shrinks the phoneme duration depending on the set speech rate. However, please note that such stretching or shrinking is normally performed only for the vowel.

The phoneme duration stretched or shrunk depending on the speech rate by the duration modification module is sent to the speech generation module.

The phoneme power determination module calculates the amplitude value of the waveform in order to send the calculated value to the speech generation module. The phoneme power is a power transition in a period corresponding to a rising portion of the phoneme in which the amplitude gradually increases, in a period corresponding to a steady state, and in a period corresponding to a falling portion of the phoneme in which the amplitude gradually decreases. The phoneme power is calculated from coefficient values in the form of a table.

The waveform generating parameters described above are sent to the speech generation module which generates the synthesized waveform.

Next, devoicing the vowel is described in detail.

When a person utters a word, air pushed out of the lungs is used as a sound source by creating an opening and closing movement of the vocal cords. Changes in resonance characteristics of the vocal tract occur by moving the chin, the tongue and lips in order to represent various phonemes. The pitch corresponds to the period of vibration of the vocal cords and thereafter a change of the pitch expresses the accents and the intonation. In addition to sounds generated by the vibration of the vocal cords, there are other types of sounds. A fricative, that is, a sound like noise, is generated by turbulence caused when air passes through a narrow space formed by a portion of the vocal tract and the tongue. Moreover, a plosive is generated by blocking the vocal tract with the tongue or the lips to temporarily stop the airflow and then releasing the airflow so as to generate an impulse-like sound.

The phonemes accompanied by the vibration of the vocal cords, that are the vowels, plosives "/b, d, g/", fricatives "/j, z/", nasal consonants and liquids such as "/m, n, r/", are referred to as voiced sounds while the phonemes accompanied by no vibration of the vocal cords, that are plosives "/p, t, k/", fricatives "/s, h, f/", for example, are referred to as voiceless sounds. In particular, consonants are classified into voiced consonants accompanied by the vibration of the vocal cords or voiceless consonants without the vibration of the vocal cords. In the case of a voiced sound, a periodical waveform is generated by the vibration of the vocal cords. On the other hand, a noise-like waveform is generated in the case of a voiceless sound.

In common language, when the word "kiku" (that is, the Japanese word meaning chrysanthemum) is naturally uttered, for example, the first vowel "i" in the word "kiku" is uttered using only breath without vibrating the vocal cords. This is a devoiced vowel.

In the text-to-speech conversion system, it is necessary to express a vowel by devoicing it in order to improve the quality of audibility. This determination is performed by the devoicing determination module. When a certain vowel is determined by the vowel devoicing determination module as being a vowel to be devoiced, the vowel is subjected to a special process in the phoneme power determination module and the phoneme duration calculation module.

The devoiced vowel is sent to the speech generation module with a phoneme power of 0 and a phoneme duration of 0, unlike a normal vowel. In this case, the phoneme duration calculation module adds the duration of the devoiced vowel to a duration of an associated consonant in order to prevent the duration of the devoiced vowel from being deleted. The speech generation module then generates the synthesized waveform using only the phoneme of the consonant without using the phoneme of the vowel.

The devoicing determination is normally performed in accordance with the following rules.

(1) A vowel "/i/" or "/u/" between voiceless consonants (including silence) is to be devoiced.

(2) However, if there is an accent nucleus, the above vowel should not be devoiced.

(3) However, if a previous vowel to the above vowel has already been devoiced, the above vowel should not be devoiced.

(4) If the above vowel appears at the end of a question, it should not be devoiced.

Please note that the above-mentioned rules are derived from general tendencies and therefore the devoicing does not always occur in accordance with these in actual utterance. Moreover, the above rules are shown as an example of rules because the devoicing rules change depending on individuals. Furthermore, in some cases, if a vowel is not devoiced because it does not fulfill rules (2), (3) and (4) although it fulfills rule (1), the vowel may be processed in a similar manner to the process for the devoiced vowel. For example, the duration of the vowel may be shortened or the amplitude value may be decreased.

Next, stretching or shrinking the waveform in the case of the devoiced vowel is described. The waveform stretching or shrinking is performed only in a period corresponding to a vowel having a periodical component. However, when the vowel is devoiced, the waveform stretching or shrinking is performed in a period corresponding to a consonant because the phoneme of the devoiced vowel is not used. The waveform stretching or shrinking by the phoneme of the vowel (voiced sound) is realized by overlapping an impulse response waveform generated by the vibration of the vocal cords, after shifting the response waveform by a repeat pitch. On the other hand, the waveform stretching or shrinking by the phoneme of the consonant (voiceless sound) was realized by inverting the waveform and then connecting the waveform at its termination to the inverted waveform.

SUMMARY OF THE INVENTION

According to the conventional duration control method for controlling the duration in the case of devoicing a vowel, the waveform is stretched or shrunk in a period corresponding to the consonant when the vowel is devoiced. Therefore, when the speech rate is made extremely slow, distinctness of the consonant for which the waveform stretching or shrinking is performed is noticeable degraded.

In addition, there is another problem where the rhythm of speech is damaged because the duration of the consonant is made extremely long, making the synthesized speech difficult to hear.

It is an object of the present invention to provide a speech synthesis apparatus that can reduce degradation of the quality of a phoneme of a devoiced vowel in the case of a slow speech rate so as to generate synthesized good quality speech with respect to the audibility.

It is another object of the present invention to provide a speech synthesis apparatus that can reduce the degradation of the quality of a phoneme of a devoiced vowel in the case of a slow speech rate, and can produce synthesized speech that has an undamaged rhythm of speech and is easy to hear and understand.

According to an aspect of the present invention, a speech synthesis apparatus includes: a text analyzer operable to generate a phonetic and prosodic symbol string from character information of input text; a word dictionary storing a reading and an accent of a word; a voice segment dictionary storing a phoneme that is a basic unit of speech; a prosody generator operable to generate synthesizing parameters including at least a phoneme, a duration of the phoneme and a fundamental frequency for the phonetic and prosodic symbol string, the prosody generator including a vowel devoicing determining means operable to determine whether or not a vowel devoicing process is to be performed and a duration modifying means operable to modify the duration of the phoneme depending on the speech rate set by a user, the vowel devoicing determining means determining that the vowel devoicing process is not performed when the set speech rate is slower than a predetermined rate; and a waveform generator operable to generate a synthesized waveform by making waveform-overlap-adding referring to the synthesizing parameters generated by the prosody generator and the voice segment dictionary.

In one embodiment of the present invention, the vowel devoicing determining means includes: a first determining means operable to make a first determination of devoicing a vowel using the input text such as a character-type and the accent, as a standard; and a second determining means operable to make a final determination of devoicing the vowel based on the result of the determination by the first determining means and the speech rate set by the user.

In another embodiment of the present invention, a threshold value used for determining that the vowel devoicing process is not performed by the vowel devoicing determining means can be set by the user.

In still another embodiment of the present invention, a threshold value used by the vowel devoicing determining means for determining that the vowel determining process is not performed is a half of a normal speech rate.

According to another aspect of the present invention, a speech synthesis apparatus includes: a text analyzer operable to generate a phonetic and prosodic symbol string from character information of an input text; a word dictionary storing a reading and accent of a word; a voice segment dictionary storing a phoneme that is a unit of speech; a prosody generator operable to generate synthesizing parameters including at least a phoneme, a duration of the phoneme and a fundamental frequency for the phonetic and prosodic symbol string, the prosody generator including a vowel devoicing determining means operable to determine whether or not a vowel devoicing process is performed and a duration modifying means operable to modify the diration of the phoneme depending on the speech rate set by a user and the result of the determination by the vowel devoicing determining means, wherein the duration modifying means does not stretch the duration of the phoneme for a voiceless sound beyond a predetermined limitation value; and a waveform generator operable to generate a synthesized waveform by making waveform-overlap-adding referring to the synthesizing parameters generated by the prosody generator and the voice segment dictionary.

In one embodiment of the present invention, the duration modifying means has a changeable limitation value depending on the type of the voiceless consonant.

In another embodiment of the present invention, the duration modifying means has a changeable limitation value depending on the length of the phoneme stored in the voice segment dictionary.

DETAILED DESCRIPTION OF PREFERRED EMBODIMENTS

Hereinafter, the present invention will be described with reference to preferred embodiments thereof. However, it should be noted that the claimed invention is not limited to the embodiments described below nor are all combinations of the features recited in the embodiments described below necessary for solving the above-described problems.

Figure 1:
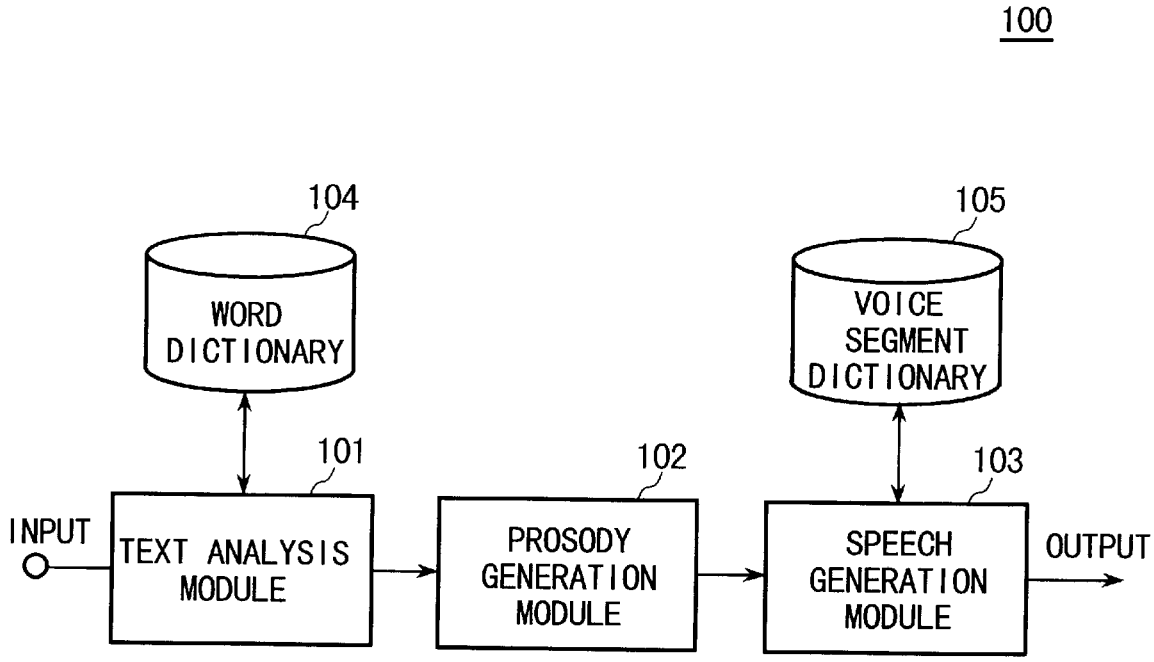
FIG. 1 is a block diagram schematically showing a structure of a speech synthesis apparatus according to the present invention.

FIG. 1 is a functional block diagram showing an entire structure of a speech synthesis apparatus 100 according to the present invention. The present invention includes a text analysis module 101, a prosody generation module 102, a speech generation module 103, a word dictionary 104 and a voice segment dictionary 105, as shown in FIG. 1. When the text analysis module 101 receives text consisting of Kanji and Kana characters input thereto, it refers to the word dictionary 104 in order to determine reading, accents and intonation of the input text, and then outputs a string of phonetic symbols with prosodic symbols. The prosody generation module 102 sets a pitch frequency pattern, a phoneme duration and the like. The speech generation module 103 performs speech synthesis. More specifically, the speech generation module 103 selects one or more speech-synthesis units from a target phonetic series with reference to speech data stored, and combines and/or modifies the selected speech synthesis units in order to obtain the synthesized speech in accordance with the parameters determined by the prosody generation module 102.

As the speech synthesis unit, a phoneme, a syllable CV, a VCV unit and a CVC unit (where C denotes a consonant and V denotes a vowel), a unit obtained by extending a phonetic chain and the like are known.

As a method of speech synthesis, a synthesizing method is known in which a speech waveform is marked with pitch marks (reference points) in advance. Then, a part of the waveform around the pitch mark is extracted. At the time of waveform synthesis, the extracted waveform is shifted in order to shift the pitch mark by a distance corresponding to a synthesizing pitch period, and is then overlapped with the shifted waveform.

In order to output more natural synthesized speech by means of the speech synthesis apparatus having the above structure, a manner of extracting the unit of the phoneme, the quality of the phoneme and a speech synthesis method are extremely important. In addition to these factors, it is important to appropriately control parameters (the pitch frequency pattern, the length of the phoneme duration, the length of a pause, and the amplitude) in the prosody generation module 102 in order to be similar to those appearing in natural speech. Here, the pause is a period of a pause appearing before and after a clause.

When the text is input to the text analysis module 101, the text analysis module 101 generates a string of phonetic and prosodic symbols (the intermediate language) from the character information. The phonetic and prosodic symbol string is a string in which the reading of the input sentence, the accents, the intonation and the like are described as a string of characters. The word dictionary 104 is a pronunciation dictionary in which readings and accents of words are stored. The text analysis module 101 refers to the word dictionary 104 when generating the intermediate language.

The prosody generation module 102 determines the synthesizing parameters including patterns such as a phoneme, duration of the phoneme, pitch and the like from the intermediate language generated by the text analysis module 101, and then outputs the determined parameters to the waveform synthesizing portion 103. The phoneme is a basic unit of speech that is used for producing the synthesized waveform. The synthesized waveform is obtained by connecting one or more phonemes. There are various phonemes depending on types of sound.

The speech generation module 103 generates the synthesized waveform based on the parameters generated by the prosody generation module 102 with reference to the voice segment dictionary 105, accumulating the phonemes and the like generated by the speech generation module 103. The synthesized speech is output via a speaker (not shown).

Figure 2:
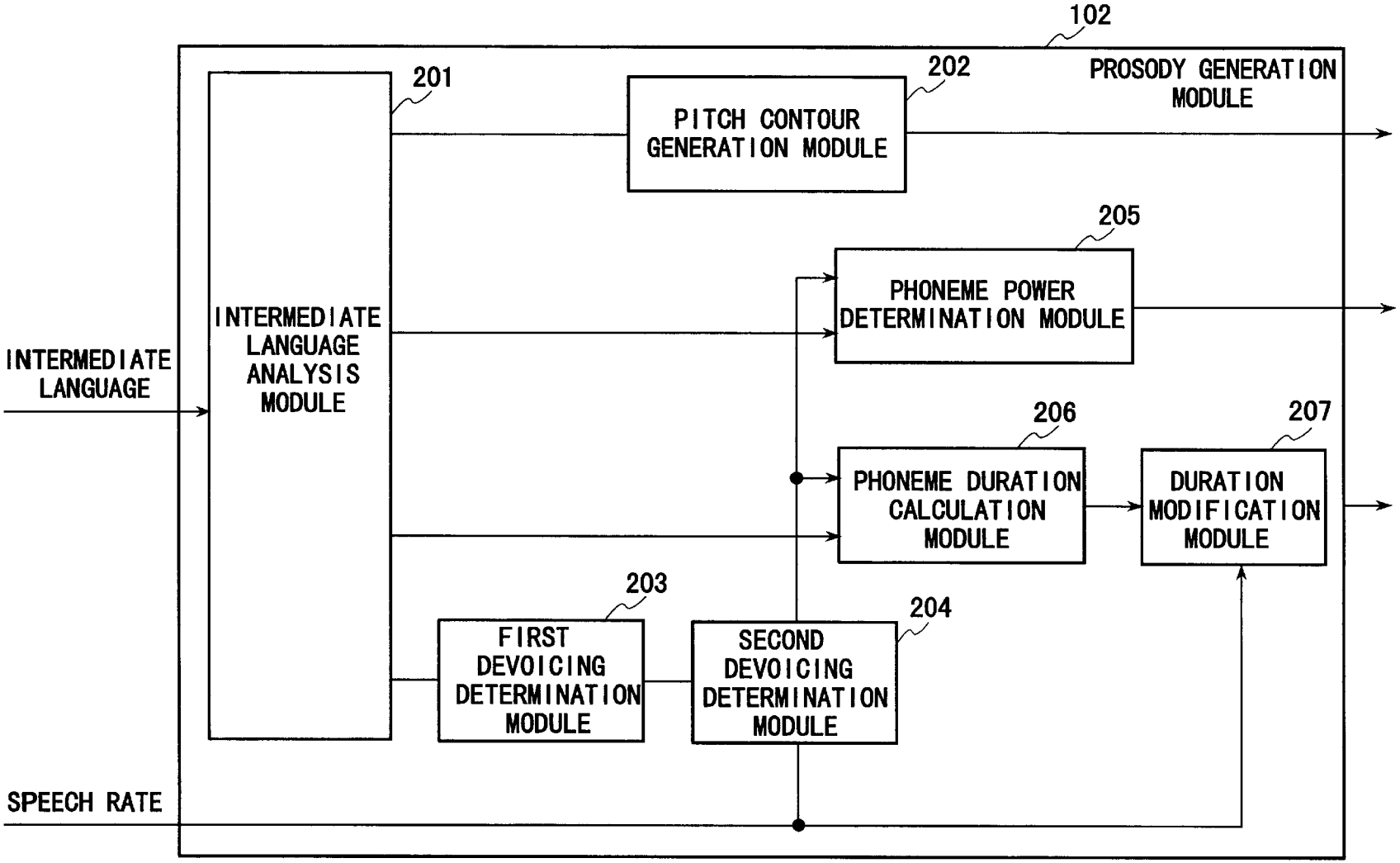
FIG. 2 is a block diagram schematically showing a structure of a prosody generation module of the speech synthesis apparatus according to the first embodiment of the present invention.

The details of the prosody generation module are described in the following. FIG. 2 is a block diagram schematically showing a structure of the prosody generation module of the speech synthesis apparatus according to the first embodiment of the present invention. As shown in FIG. 2, the prosody generation module 102 includes an intermediate language analysis module 201, a pitch contour generation module 202, a first devoicing determination module 203 (a first determining means), a second devoicing determination module 204 (a second determining means), a phoneme power determination module 205, a phoneme duration calculation module 206 and a duration modification module 207 (a duration modifying means).

The intermediate language in which the prosodic symbols are added and the speech rate parameter set by a user are input to the prosody generation module 102. In some cases, a voice parameter such as the pitch of voice or magnitude of intonation, may be set externally.

The intermediate language is input to the intermediate language analysis module 201, while the speech rate parameter set by the user is input to the second devoicing determination module 204 and the duration modification module 207. Part of parameters output from the intermediate language analysis module 201, such as a phrase-end symbol, a word-end symbol and an accent symbol, are input to the pitch contour generation module 202. The parameters such as a string of phonetic symbols, the word-end symbol and the accent symbol are input to the phoneme power determination module 205 and the phoneme duration calculation module 206. The parameters such as the phonetic symbol string and the accent symbol are also input to the first devoicing determination module 203.

The pitch contour generation module 202 calculates data such as the creation time and magnitude of a phrase command, start time, end time and magnitude of an accent command and the like from the parameters input thereto, thereby generating a pitch contour. The generated pitch contour is input to the speech generation module 103.

The first devoicing determination module 203 determines whether or not a vowel is to be devoiced, using only input text such as character-type and the accent as a standard. The determination result is output to the second devoicing determination module 204.

The second devoicing determination module 204 performs final determination of whether or not a vowel is to be devoiced based on the result of the determination by the first devoicing determination module 203 and the speech rate level set by the user. The result of the final determination is output to the phoneme power determination module 205 and the phoneme duration calculation module 206.

The phoneme power determination module 205 calculates an amplitude shape of each phoneme from the result of the determination of whether or not the vowel is to be devoiced and the phonetic symbol string input from the intermediate language analysis module 201. The calculated amplitude shape is output to the speech generation module 103.

The phoneme duration calculation module 206 calculates the duration of each phoneme from the result of the determination of devoicing the vowel and the phonetic symbol string input from the intermediate language analysis module 201. The calculated duration is output to the duration modification module 207.

The duration modification module 207 modifies the duration of the phoneme using the speech rate parameter set by the user, and outputs the modified duration to the speech generation module 103.

The first devoicing determination module 203 and the second devoicing determination module 204 constitute as a whole a vowel devoicing determining means that changes, in accordance with the speech rate, the standard for the determination of whether or not the vowel-devoicing is to be performed.

Next, an operation of the speech synthesis apparatus having the structure described above and a speech-synthesis-by-rule method are described. The operation of the speech synthesis apparatus in the present embodiment is the same as that of the conventional one except for processes in the prosody generation module 102.

First, the user sets the speech rate level in advance. The speech rate is given as a parameter indicating how many moras per minute the speech is uttered. The parameter is quantized in order to be at one of 5–10 levels, and is provided with a value indicating the corresponding level. In accordance with this level, the process of stretching the duration or the like is performed. In addition, a parameter for controlling voice, such as a voice pitch or intonation may be set by the user. To this parameter, a predetermined value (default value) is assigned as the user's set value, if the user does not set this value.

As shown in FIG. 2, the parameter for speech rate control set by the user is sent to the second devoicing determination module 204 and the duration modification module 207 included in the prosody generation module 102. The other input to the prosody generation module 102, i.e., the intermediate language, is supplied to the intermediate analyzing portion 201 so as to be subjected to analysis of the input character string. The analysis in the intermediate analyzing portion 201 is performed sentence-by-sentence, for example. Then, from the intermediate language corresponding to one sentence, the number of phrase commands, the number of moras in each phrase command, the number of accent commands, the number of moras in each accent command and the accent type of each accent command, for example, are sent to the pitch contour generation module 202 as parameters related to synthesis of the pitch contour.

The pitch contour generation module 202 calculates the magnitude, the rising position and the falling position of each phrase command and each accent command from the parameters input thereto using a statistical analysis such as Quantification theory (type one), and generates the pitch contour using a predetermined response function. Quantification theory (type one) is a kind of factor analysis, and it can formulate the relationship between categorical and numerical values. The obtained pitch contour is sent to the speech generation module 103.

The accent symbol and the phonetic character string are sent to the first devoicing determination module 203 in which it is determined whether or not the vowel is to be devoiced. In the first devoicing determination module 203, the determination is performed based only on a series of characters. The determination result is sent to the second devoicing determination module 204 as a temporal determination result.

The speech rate level set by the user is also input to the second devoicing determination module 204 which conducts the secondary determination of whether or not the vowel is to be devoiced based on both the speech rate level and the first (temporal) determination result. In the second determination, the speech rate is compared with a certain threshold value to determine whether or not the speech rate exceeds the threshold value, and the vowel is not devoiced when the speech rate is determined to be slow based on the comparison result.

Subsequently, the final determination of whether or not the vowel is to be devoiced is performed. The result of the final determination is sent to the phoneme power determination module 205 and the phoneme duration calculation module 206.

The phoneme power determination module 205 calculates the amplitude value of a waveform for each phoneme or syllable from parameters such as the phonetic character string previously input from the intermediate language analysis module 201. The calculated amplitude value is output to the speech generation module 103.

The phoneme power is a power transition in a period corresponding to a rising part of the phoneme in which the amplitude value gradually increases, in a period of a steady state, and in a period corresponding to a falling part of the phoneme in which the amplitude value gradually decreases. The phoneme power is normally calculated from coefficient values that are stored in the form of a table. When the input from the second devoicing determination module 204 indicates that the vowel in question is determined to be to be devoiced, the phoneme power of the vowel in question is set to 0.

The phoneme duration calculation module 206 calculates the duration of each phoneme or syllable from parameters such as the phonetic character string previously input from the intermediate language analysis module 201, and outputs the calculated duration to the duration modification module 207. In general, the calculation of the phoneme duration uses rules or a statistical analysis such as Quantification theory (type one), depending on the type of an adjacent or close phoneme. The calculated phoneme duration is a value in a case of a normal (default) speech rate. When the input from the second devoicing determination module 204 indicates that the syllable is to be devoiced, an operation in which the calculated duration of the vowel is added to the duration of a corresponding consonant is performed.

The duration modification module 207 modifies the phoneme duration depending on the speech rate parameter set by the user. Assuming that the normal speech rate is 400 [moras/minute], an operation for multiplying the duration length of a vowel and 400/Tlevel together, where Tlevel [moras/minute] is a value set by the user. The modified phoneme duration is sent to the speech generation module 103.

Next, the determination of whether or not a vowel is to be devoiced is described in detail referring to a flow chart.

Figure 3:
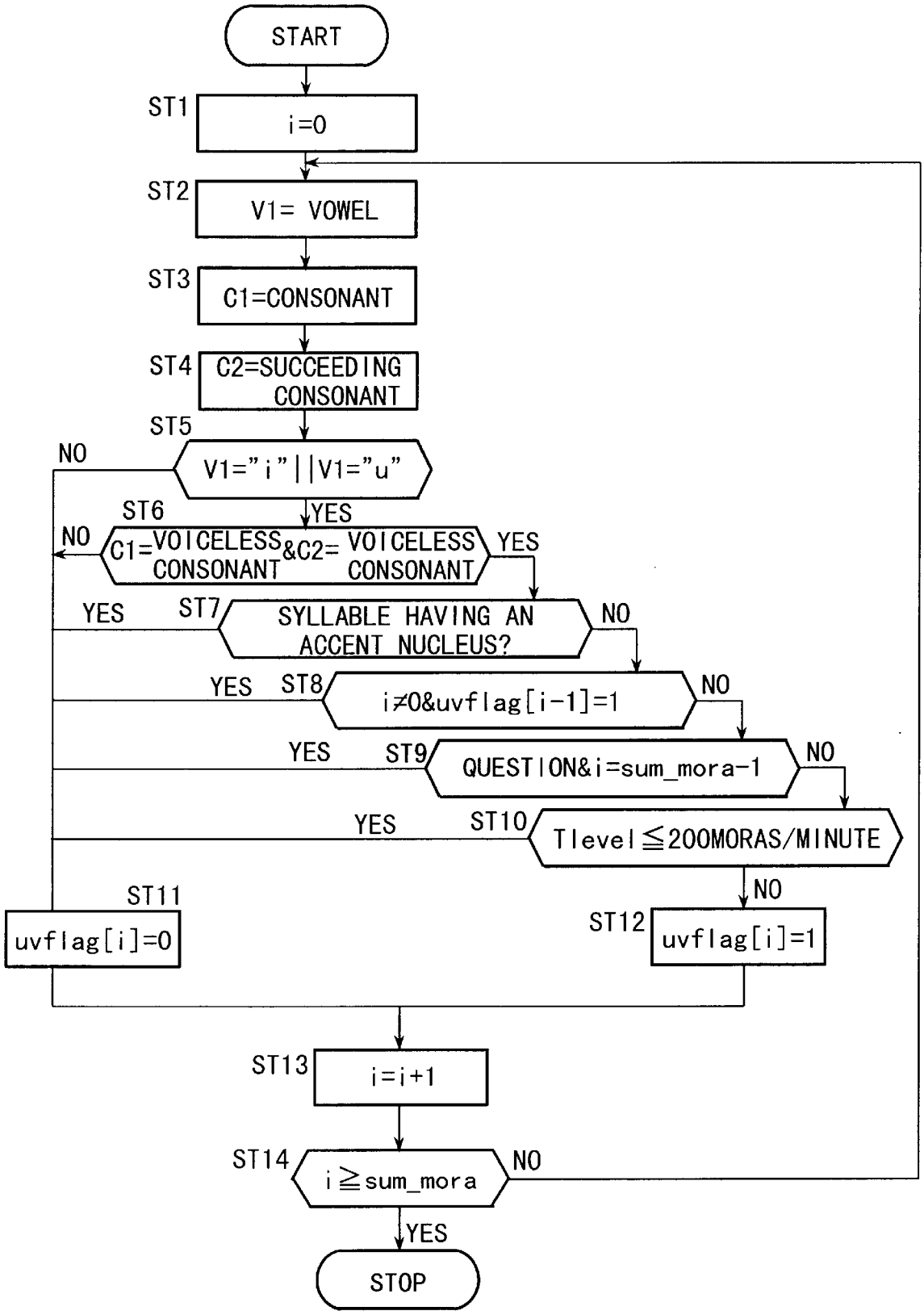
FIG. 3 is a flow chart showing the flow of devoicing a vowel in the prosody generation module according to the first embodiment of the present invention.

FIG. 3 is a flow chart showing the flow of the vowel devoicing determination in which procedures of the first and second determinations are illustrated. In FIG. 3, STn denotes each step of the flow.

It is assumed that the speech rate set by the user is set to Tlevel at an initial state. The parameter Tlevel is set, for example, as a value indicating the number of moras uttered in one minute. In this case, Tlevel is set to 400 [moras/minute], for example, as a default value if the user has not set Tlevel.

First, in Step ST1, a syllable pointer i, that is used for searching the input intermediate language syllable-by-syllable, is initialized to be 0. In Step ST2, a type of a vowel (a, i, u, e, o) in the i-th syllable is set to be V1.

Next, a type of a consonant (voiceless consonant or silence/voiced consonant) in the i-th syllable is set to be C1 in Step ST3, and a type of a consonant in the next syllable, i.e., the (i+1) th syllable is set to be C2 in Step ST4.

In Step ST5, it is determined whether or not the vowel V1 is "i" or "u". If the vowel V1 is "i" or "u", the procedure goes to Step ST6. Otherwise, it is determined that the vowel V1 is not to be devoiced, and the procedure goes to Step ST 11.

In Step ST6, it is determined whether each of the consonants C1 and C2 are a voiceless consonant or correspond to an end of the sentence or a pause. If both consonants C1 and C2 are determined to be voiceless consonants or silence, the procedure goes to Step ST7 in which it is determined whether or not there is an accent nucleus in the syllable in question.

In a syllable having an accent nucleus, there is a transition of pitch from a high pitch to a low pitch. Since such a time-variant change of pitch represents stress in audibility, the devoicing operation should not be performed. For example, "chi'shiki", which means knowledge in Japanese, has the accent on the first syllable. In this word, the first vowel "i" is located between the devoiced consonants "ch" and "sh". Thus, in order to clearly represent the accent nucleus, the first syllable "chi" is uttered by vibrating the voice cords intentionally in natural speech .

If the syllable in question has no accent nucleus, it is then determined in Step ST8 whether or not the previous syllable was devoiced.

This is because it is unlikely that devoicing successively occurs. For example, in the word "kikuchi", which means one part of a Japanese last name, the first vowel "i" is devoiced because this vowel is located between devoiced consonant "k". The second vowel "u", however, is not devoiced although it is located between the devoiced consonants "k" and "ch", so that "ku" is uttered by vibrating the voice cords in natural speech.

If the syllable in question is the first syllable in the sentence, or the previous syllable of the syllable in question was not devoiced, it is determined in Step ST9 whether or not the syllable in question is an end of a question.

The devoicing does not occur at the question end because the pitch ascends quickly. For example, when comparing " . . . shimasu" (which is a typical end of a courteous affirmative sentence in Japanese) and " . . . shimasu?" (which is a typical end of a courteous question), the last syllable of the question is uttered as obviously including a clear intent of emphasis. Therefore, the devoicing does not occur at the question end.

If it is determined that the syllable in question is not at the question end in Step ST9, the flow goes to Step ST10. In Step ST10, it is determined whether or not the speech rate set by the user exceeds a predetermined limitation value. In the present embodiment, the predetermined limitation value is set to 200 [moras/minute].

When Tlevel set by the user is equal to or less than 200 [moras/minute], that is, the speech rate is slow, the flow goes to Step ST11 in which the devoicing is not performed. On the other hand, when the Tlevel exceeds 200 [moras/minute], that is, the speech rate is fast, the flow goes to Step ST12 in which the devoicing is performed.

If the vowel V1 is not "i" or "u" in Step ST5; the consonants C1 and C2 are not voiceless consonants in Step ST6; the syllable in question has the accent nucleus in Step ST7; the previous syllable was devoiced in Step ST8; the syllable in question is at the end of the question in Step ST9; or the speech rate set by the user exceeds the predetermined limitation value in Step ST10, it is then determined that the devoicing is not performed. Then the flow goes to Step ST11. In Step ST11, an i-th vowel devoicing flag uvflag[i] is set to 0, thereby completing the process for the i-th syllable.

On the other hand, in Step ST12, the i-th vowel devoicing flag uvflag[i] is set to 1, thereby completing the operation for the i-th syllable.

After Step ST11 or ST12, a syllable counter i is increased by 1 in Step ST13. Then, in Step ST14, it is determined whether or not the syllable counter i is equal to or larger than the total number of the moras sum_mora (i≧sum_mora). If the syllable counter i is smaller than sum_mora, that is, i<sum_mora, the procedure goes back to Step ST12, and a similar process is performed for the next syllable.

After the above-mentioned process is performed for all syllables in the input text, that is, when the syllable counter i is determined to exceed sum_mora in Step ST 14, the procedure ends.

As described above, the speech synthesis apparatus according to the first embodiment includes the prosody generation module 102 which comprises the intermediate language analysis module 201; the pitch contour generation module 202; the first devoicing determination module 203 that determines whether or not a vowel is to be devoiced using only the input text such as the character-type or the accent as the standard; the second devoicing determination module 204 that makes the final determination of devoicing based on the result of the first vowel devoicing determination and the speech rate set by the user; the phoneme power determination module 205; the phoneme duration calculation module 206; and the duration modification module 207 that modifies the phoneme duration depending on the speech rate set by the user. The speech synthesis apparatus according to the first embodiment performs a vowel devoicing process using rules similar to those conventionally known at a normal speech rate or a fast speech rate, but does not perform the vowel devoicing operation at a slow speech rate. Therefore, degradation of distinctness of the voiceless consonant caused by the vowel devoicing process at the slow speech rate can be prevented, thus producing a synthesized speech with excellent audible quality.

According to a conventional method for controlling the duration while the corresponding vowel is devoiced, the waveform stretching or shrinking is performed in a period of the associated consonant. This degrades the distinctness of the consonant in the case of an extremely low speech rate. On the other hand, according to the present embodiment, it is determined in accordance with the speech rate whether or not the vowel devoicing process is performed. Therefore, disadvantages exist such as the degradation of the distinctness of the consonant caused by an extremely long duration of a voiceless consonant. Accordingly, easy to hear and understand synthesized speech can be produced.

In the prosody generation module 102 of the first embodiment, the standard for the determination of the vowel devoicing process is set to 200 [moras/minute], which corresponds to half of the normal speech rate. However, the standard for the determination is not limited thereto. The above value or a value close to the above value is found from experimental results to be appropriate. Alternatively, the value of the standard may be set directly by the user. In this case, the conventional procedure is performed when the user sets the standard for the determination to 0.

In the flow of the vowel devoicing determination shown in FIG. 3, several comparisons are performed in Steps ST6 to ST10. Please note that the order of these comparisons are not limited to that shown in FIG. 3. For example, the comparison of the speech rate in Step ST10 may be performed first. By doing this, it can be expected that the remaining part of the procedure is saved. In this case, the operation by the first devoicing determination module 203 and that by the second devoicing determination module 204 are performed in a converse order.

In addition, the rules for devoicing the vowel are not limited to those shown in FIG. 3. It is preferable to use more detailed rules. Moreover, the normal speech rate is assumed to be 400 [moras/minute] in the present embodiment because this value is generally used. However, the value for the normal speech rate is not limited to this value.

In the prosody generation module 102 according to the first embodiment, the degradation of the distinctness of the voiceless consonant caused by the vowel devoicing when the speech rate is slow is prevented by modifying the devoicing determination depending on the level of the speech rate. However, when the speech rate is below a predetermined value, no vowel devoicing occurs, resulting in a degraded rhythm when the synthesized speech is heard as a whole. In order to solve such a problem, a prosody generation module 102 according to the second embodiment of the present invention modifies the duration of the phoneme when the vowel is devoiced, thereby reducing the degradation of the quality of the syllable in which the vowel is devoiced even when the speech rate is below the predetermined value. As a result, synthesized speech can be produced that has undamaged speech rhythm and is easy to hear.

Figure 4:
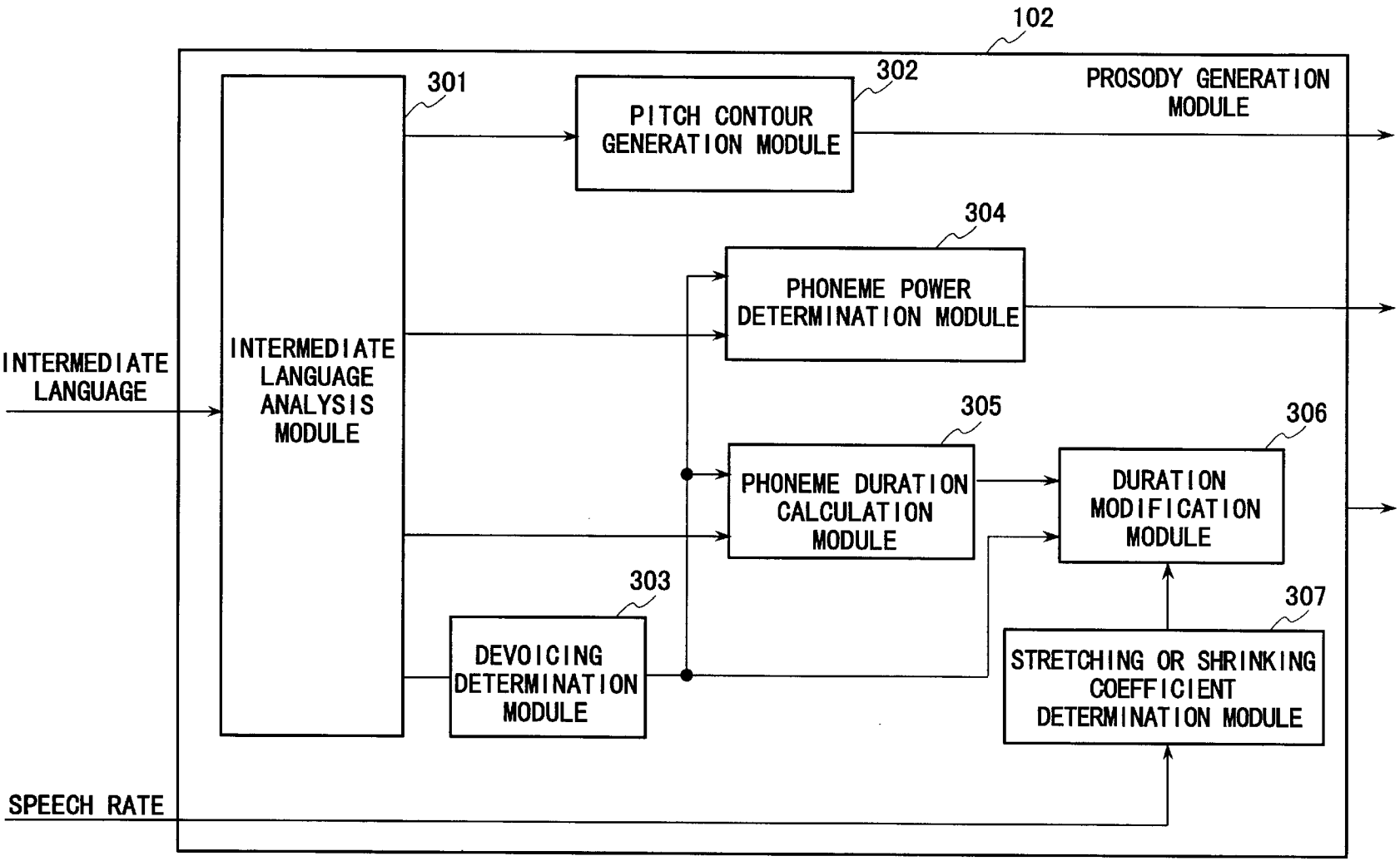
FIG. 4 is a block diagram schematically showing the structure of the prosody generation module of the speech synthesis apparatus according to a second embodiment of the present invention.

FIG. 4 is a block diagram schematically showing a structure of the prosody generation module 102 of the speech synthesis apparatus according to the second embodiment of the present invention. The main features of the present embodiment are the devoicing determining means and how to implement the devoicing determining means, as in the first embodiment.

As shown in FIG. 4, the prosody generation module 102 includes an intermediate language analysis module 301, a pitch contour generation module 302, a devoicing determination module 303 (a vowel devoicing determining means), a phoneme power determination module 304, a phoneme duration calculation module 305, a duration modification module 306 and a stretching or shrinking coefficient determining portion 307.

An intermediate language in which prosodic symbols are added is input to the prosody generation module 102, as in the conventional techniques. Speech rate parameters set by the user are also input to the prosody generation module 102. Voice parameters such as voice pitch or magnitude of intonation may be set externally depending on the user's preference or the usage.

The intermediate language that is subjected to the speech synthesis is input to the intermediate analyzing portion 301, while the speech rate parameters set by the user are input to the stretching or shrinking coefficient determining portion 307.

Parameters such as a phrase-end symbol, a word-end symbol, an accent symbol, that are output from the intermediate language analysis module 301 are input to the pitch contour generation module 302; parameters such as a string of phonetic symbols, the word-end symbol and the accent symbol are input to the phoneme power determination module 304 and the phoneme duration calculation module 305; and parameters such as the string of phonetic symbols and the accent symbol are input to the devoicing determination module 303.

The pitch contour generation module 302 calculates the creation time and the magnitude of a phrase command, a start time, an end time and the magnitude of an accent command from the input parameters, thereby generating the pitch contour. The generated pitch contour is input to the speech generation module 103.

The devoicing determination module 303 determines whether or not a vowel in question is to be devoiced using the input text such as the character-type and the accent, as a standard. The determination result is output to the phoneme power determination module 304 and the duration modification module 306.

The phoneme power determination module 304 calculates the amplitude shape of each phoneme from the result of the vowel devoicing determination and the phonetic symbol string input from the intermediate language analysis module 301. The calculated amplitude shape is output to the speech generation module 103.

The phoneme duration calculation module 305 calculates the duration of each phoneme from the phonetic symbol string input from the intermediate language analysis module 301. The result of the calculation is output to the duration modification module 306.

The stretching or shrinking coefficient determination module 307 calculates a coefficient value used for modifying the duration of the phoneme, from the speech rate parameter set by the user, and outputs the coefficient value to the duration modification module 306.

The duration modification module 306 modifies the duration by multiplying the output value from the phoneme duration calculation module 305 by the output value from the stretching or shrinking coefficient determination module 307, taking the output value from the devoicing determination module 303 into consideration. The result of the modification is output to the speech generation module 103.

The duration modification module 306 and the stretching or shrinking coefficient determination module 307 constitute as a whole a duration modifying means operable to modify the duration of the phoneme in accordance with the speech rate set by the user and the result of the determination by the devoicing determination module 303.

An operation of the speech synthesis apparatus having the above-described structure is described below. The main features in the present embodiment are in a method for modifying the duration of the phoneme when a vowel is devoiced in the prosody generation module 102.

First, the user sets the level of the speech rate in advance. The speech rate is set as a parameter indicating how many moras are uttered in a minute, and is quantized so that the level of the speech rate is any of 5 to 10 levels. Depending on the level, the process for stretching the duration of the phoneme, for example, is performed. As the speech rate decreases, the duration becomes longer. Contrary to this, the duration becomes shorter as the speech rate increases. In addition, the user can set another parameter for controlling voice, such as the pitch of the voice or intonation. If the user does not set the voice controlling parameter, a predetermined value (default value) is assigned.

As shown in FIG. 4, the parameter for controlling the speech rate is sent to the stretching or shrinking coefficient determination module 307 included in the prosody generation module 102. The stretching or shrinking coefficient determination module 307 determines a multiplier used for stretching or shrinking the duration. Assuming that a normal speech rate is 400 [moras/minute], a duration modifying coefficient tpow that depends on the speech rate is defined as 400/Tlevel, where Tlevel [moras/minute] is the user's set speech rate. The duration modifying coefficient tpow is sent to the duration modification module 306 where the coefficient tpow is used for stretching or shrinking the duration as described in detail.

The other input to the prosody generation module 102, i.e., the intermediate language, is sent to the intermediate analyzing portion 301, and is subjected to analysis of the input character string in order to generate parameters related to generation of the pitch contour. In the present embodiment, the analysis in the intermediate analyzing portion 301 is performed sentence-by-sentence. The number of phrase commands, the number of moras in each phrase command, the number of accent commands, the number of moras in each accent command and the type of each accent command are sent to the pitch pattern generation module 302 as the parameters related to the generation of the pitch contour.

The pitch contour generation module 302 calculates the magnitude of each phrase or accent command and the rising position and the falling position in each phrase or accent command from the input parameters by a statistical analysis such as Quantification theory (type one), in order to generate the pitch contour by using a predetermined response function. The generated pitch contour is sent to the speech generation module 103.

The accent symbol string and the phonetic character string are sent to the devoicing determination module 303 and is subjected to the determination of whether or not the vowel is to be devoiced. The result of the determination is sent to the phoneme power determination module 304 and the duration modification module 306.

The phoneme power determination module 304 calculates the amplitude value of the waveform for each phoneme or syllable from parameters such as the phonetic character string previously input from the intermediate language analysis module 301. The calculated amplitude value is output to the speech generation module 103. The phoneme power is a power transition in a period corresponding to the rising portion of the phoneme in which the amplitude gradually increases, in a period of the steady state, and in a period corresponding to the falling portion of the phoneme in which the amplitude gradually decreases. Typically, the amplitude value is calculated from coefficient values in the form of a table.

For vowel indicated by the input from the devoicing determination module 303 to be devoiced, the phoneme power is set to 0. The phoneme duration calculation module 305 calculates the duration of each phoneme or syllable from parameters such as the phonetic character string previously input from the intermediate language analysis module 301. The calculated duration is output to the duration modification module 306. In general, the calculation of the duration of the phoneme is performed using rules or a statistical technique such as Quantification theory (type one), depending on the type of the adjacent or close phoneme. It should be noted that the phoneme duration calculated here is a value calculated in a case of a normal speech rate.

The duration modification module 306 modifies the phoneme duration input from the phoneme duration calculation module 305, using the result of the vowel devoicing determination and the stretching or shrinking coefficient. When the input from the devoicing determination module 303 indicates that the vowel in question is not to be devoiced, the duration modification module 306 multiplies the duration of the vowel in question by the duration modifying coefficient tpow that is output from the coefficient determination module 307. On the other hand, when the input from the devoicing determination module 303 indicates that the vowel in question is to be devoiced, the duration modification module 306 adds the duration of the vowel in question to the duration of the associated consonant and then multiples the resultant duration by the duration modifying coefficient tpow. However, there is a limitation to the duration coefficient in order to keep the result of the multiplication within a value a predetermined times the duration of the consonant. The modified duration of the phoneme is sent to the speech generation module 103.

Next, the determination of the duration is described in detail referring to a flow chart.

Figure 5:
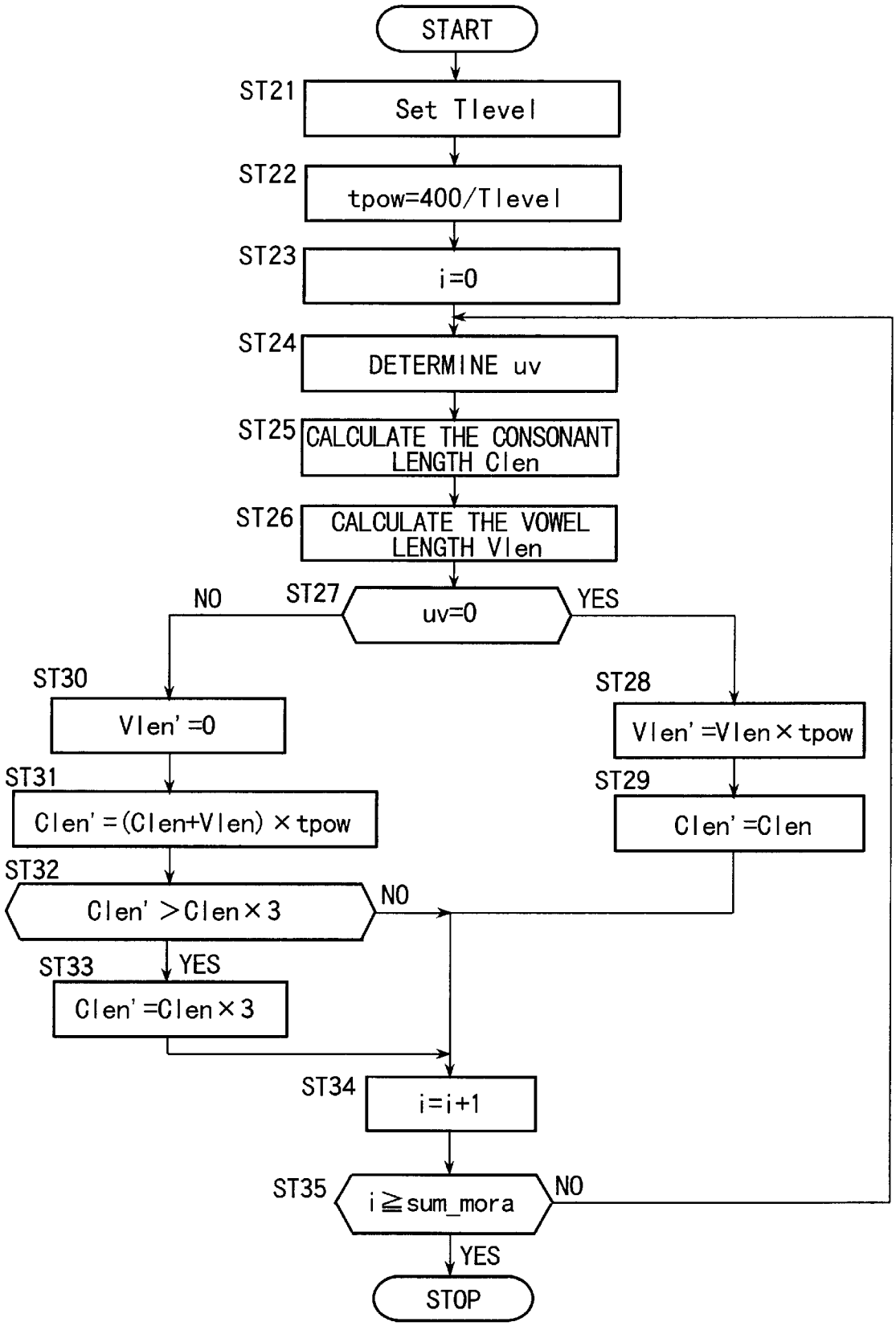
FIG. 5 is a flow chart showing a flow of determining a duration of a phoneme in the prosody generation module according to the second embodiment of the present invention.

FIG. 5 is a flow chart showing a procedure of determining the duration of the phoneme. In FIG. 5, STn denotes a step in the procedure.

It is assumed that the speech rate set by the user is Tlevel at an initial state (Step ST21). Tlevel is set as a value indicating the number of the moras uttered in a minute. In a case where the user does not set a specific value for Tlevel, Tlevel is set to a default value, for example, 400 [moras/minute].

In Step ST22, the duration modifying coefficient tpow that depends on the speech rate is obtained by Expression (1).

$$tpow=400/\mathrm{Tlevel} \tag{1}$$

Then, a syllable pointer i for making a syllable-by-syllable search in the intermediate language is initialized to be 0 in Step ST23. In Step ST24, the i-th syllable is subjected to the vowel devoicing determination. When it is determined that the vowel in the i-th syllable is to be devoiced, uv is set to 1. On the other hand, when it is determined that the vowel in the i-th syllable is not to be devoiced, uv is set to 0.

Next, the length Clen of the consonant in the i-th syllable is calculated in Step ST25, and the length Vlen of the vowel in the i-th syllable is calculated in Step ST26. It should be noted that any calculation method can be used for the calculations of Clen and Vlen.

In Step ST27, the result of the vowel devoicing determination, that is the value of uv determined in Step ST24, is referred to in order to modify the calculated duration of the phoneme. This is because the process for modifying the phoneme duration changes depending on whether or not the syllable in question is devoiced. The result of the modification, i.e., the phoneme durations of the consonant and the vowel after being modified are stored as Clen' and Vlen', respectively.

When uv=0, the syllable in question is determined as having no vowel to be devoiced. Then, the phoneme duration of the vowel in the syllable is stretched or shrunk by Expression (2) in Step ST28.

$$Vlen'=Vlen\times tpow \tag{2}$$

As for the consonant, the phoneme duration thereof is not modified. Therefore, the phoneme duration Clen of the consonant is stored as Clen' (Clen'=Clen) in Step ST29, and the syllable counter i is increased by 1 in Step ST34 so that the procedure is performed for the next syllable.

On the other hand, when uv=1, it is determined that the vowel in the syllable in question is to be devoiced. In this case, the phoneme duration of the voiceless consonant is stretched in Steps ST30 to ST33. More specifically, the phoneme duration Vlen of the vowel is set to 0 in Step ST30, and the phoneme duration Clen of the consonant is stretched by Expression (3) in Step ST31.

$$Clen'=(Clen+Vlen)\times tpow \tag{3}$$

In a case of devoicing the vowel, the vowel is mixed with the consonant. Therefore, as expressed by Expression (3), the phoneme duration Vlen of the vowel is added to the duration Clen of the consonant, and then result is multiplied by the modifying coefficient tpow.

Subsequently, in Step ST32, whether or not the result of the modification exceeds the limitation value (Clen'>Clen×3) is determined. In the present embodiment, the limitation value is defined as being three times the original duration of the consonant.

If the result of the modification does not exceed the limitation value, the syllable counter i is increased by one in Step ST34 and then the a similar procedure is performed for the next syllable. Otherwise, the modified duration of the consonant is modified again so as to be equal to the limitation value in Step ST33. Then, the syllable counter i is increased by one in Step ST34, and thereafter it is determined whether or not the syllable counter i is equal to or larger than the total number of the moras sum_mora (i≧sum_mora) in Step ST35. When i<sum_mora, the procedure goes back to Step ST24 so that a similar procedure is performed for the next syllable.

The procedure described above is terminated after being performed for all the syllables in the input text, that is, at the time when the syllable counter i is determined to exceed sum_mora in Step ST35.

Figure 6:
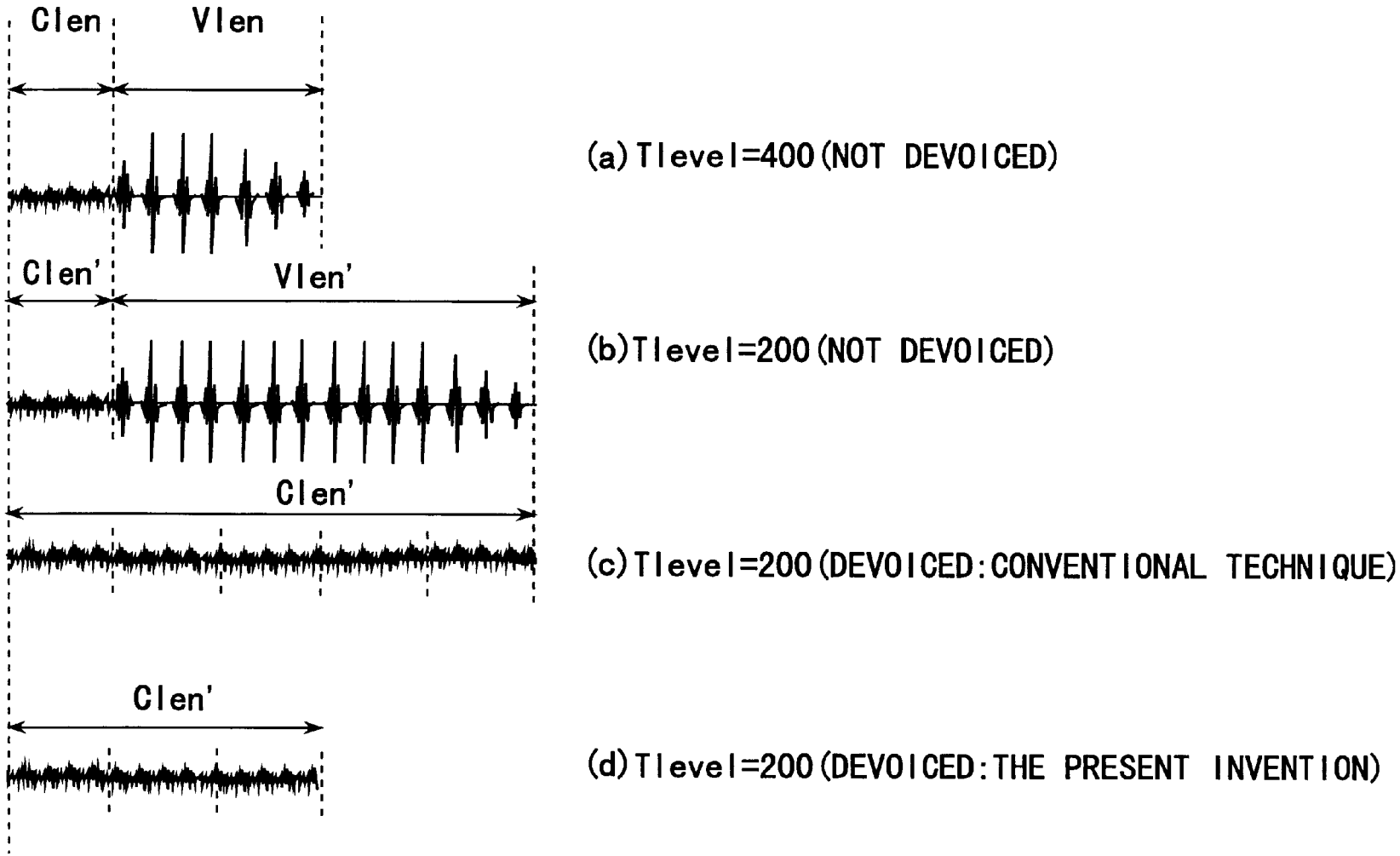
FIGS. 6A, 6B, 6C and 6D show stretching or shrinking the duration in the prosody generation module according to the second embodiment of the present invention.

FIGS. 6A to 6D are diagrams for explaining stretching or shrinking the duration described above. FIG. 6A shows a waveform of a syllable including no devoiced vowel at the normal speech rate, i.e., the speech rate of 400.

At the time at which Step ST26 in the flow shown in FIG. 5 is done, waveforms shown in FIG. 6A are obtained in periods that respectively correspond to the duration of the consonant Clen and that of the vowel Vlen. In a case where devoicing is not performed, when a syllable having such a waveform is modified by the speech rate Tlevel set by the user, the waveform is changed into a waveform shown in FIG. 6B, in which the duration of the vowel Vlen is stretched to Vlen' while the duration of the consonant Clen remains unchanged, i.e., Clen=Clen'. In the present embodiment, since Tlevel is 200, only the duration of the vowel is doubled.

Next, a case where the vowel in the syllable having the waveform shown in FIG. 6A is devoiced is considered. According to the conventional technique, the duration of the vowel is set to 0, and the duration of the whole syllable after being stretched is given only to the consonant, as shown in FIG. 6C. The waveform shown in FIG. 6C is obtained by inverting a part between two broken lines and connecting the inverted part to the original part repeatedly, because the voiceless consonant is stretched by inverting the waveform thereof and connecting the original waveform at a termination thereof to the inverted waveform. On the other hand, according to the present invention, because the stretched length of the voiceless consonant is limited to a length three times the original length, the modified waveform as shown in FIG. 6D is obtained. Accordingly, as is apparent from FIGS. 6C and 6D, the voiceless consonant can be prevented from being extremely longer even if the speech rate is slow, thereby preventing a noticeable degradation of the distinctness.

As described above, the speech synthesis apparatus according to the second embodiment of the present invention includes the prosody generation module 102 which comprises: the stretching or shrinking coefficient determination module 307 that calculates the coefficient value for modifying the phoneme duration from the speech rate parameter set by the user and outputs the calculated coefficient value to the duration modification module 306; and the duration modification module 306 that modifies the duration by multiplying the output value from the phoneme duration calculation module 305 by the output value from the stretching or shrinking coefficient determination module 307, taking the output value from the devoicing determination module 303 into consideration, wherein stretching the duration of the voiceless consonant is limited in order not to exceed the limitation value. Therefore, the problem where the duration of the voiceless consonant is made extremely long by the vowel devoicing determining process and therefore the distinctness of the speech is degraded can be eliminated. Accordingly, synthesized speech that is easy to hear can be produced.

Thus, according to the second embodiment, the phoneme duration when the vowel is devoiced can be controlled with a simple structure, thus, synthesized speech having natural rhythm can be obtained, as in the first embodiment.

Although stretching the duration of the voiceless consonant in the prosody generation module 102 is limited to three times the original duration thereof in the second embodiment, the present invention is not limited thereto. It is more effective that the limitation value is changed depending on the type of the voiceless sound. For example, as for a voiceless fricative such as "s", the limitation value may be set to be three times the original duration because there is less degradation even if the voiceless fricative is stretched. As for a voiceless plosive such as "k", the limitation value may be set to be twice the original duration because the voiceless plosive degrades dramatically. In addition, the limitation value is defined as a multiple of the duration calculated by the phoneme duration calculation module by a technique such as Quantification theory (type one). However, the definition of the limitation value is not limited to the above. Alternatively, the limited value may be defined using the length of the phoneme stored in the voice segment dictionary as a standard.

Moreover, the durations after being modified are stored as new variables Clen'and Vlen'in the flow of determining the phoneme duration shown in FIG. 5. However, the durations Clen and Vlen may be modified directly. This can eliminate the process where Clen'=Clen in Step ST29. Furthermore, although the speech rate of 400 [moras/minute] is used as the normal speech rate in the present embodiment, the normal speech rate is not limited to this value. This value is a typically used speech rate.

The duration controlling method for speech-synthesis-by-rule in each embodiment may be implemented by software with a general-purpose computer. Alternatively, it may be implemented by dedicated hardware (for example, text-to-speech synthesis LSI). Alternatively, the present invention may be implemented using a recording medium such as a floppy disk or CD-ROM, in which such software is stored and by having the general-purpose computer execute the software.

The speech synthesis apparatus according to each of the embodiments of the present invention can be applied to any speech synthesis method that uses text data as input data, as long as the speech synthesis apparatus obtains a given synthesized speech by rules. In addition, the speech synthesis apparatus according to each embodiment may be incorporated as a part of a circuit included in various types of terminals.

Furthermore, the number, the configuration or the like of the dictionary or the circuit constituting the speech synthesis apparatus according to each embodiment are not limited to those described in each embodiment.

In the above, the present invention has been described with reference to the preferred embodiments. However, the scope of the present invention is not limited to that of the preferred embodiments. It would be appreciated by a person having ordinary skill in the art that various modifications can be made to the above-described embodiments. Moreover, it is apparent from the appended claims that embodiments with such modifications are also included in the scope of the present invention.

What is claimed is:

1. A speech synthesis apparatus comprising:

a text analyzer operable to generate a phonetic and prosodic symbol string from character information of an input text;

a word dictionary storing a reading and accent of a word;

a voice segment dictionary storing a phoneme that is a basic unit of speech;

a prosody generator operable to generate synthesizing parameters including at least a phoneme, a duration of the phoneme and a fundamental frequency for the phonetic and prosodic symbol string, the prosody generator including a vowel devoicing determining means operable to determine whether or not a vowel devoicing process is to be performed and a duration modifying means operable to modify the duration of the phoneme depending on a speech rate set by a user, the vowel devoicing determining means determining that the vowel devoicing process is not devoiced when the set speech rate is slower than a predetermined rate; and a waveform generator operable to generate a synthesized waveform by making waveform-overlap-adding referring to the synthesizing parameters generated by the prosody generator and the voice segment dictionary.

2. A speech synthesis apparatus according to claim 1, wherein the vowel devoicing determining means comprises: a first determining means operable to make a first determination of devoicing a vowel using the input text such as a character-type and the accent, as a standard; and a second determining means operable to make a final determination of devoicing the vowel based on a result of the determination by the first determining means and the speech rate set by the user.

3. A speech synthesis apparatus according to claim 1, wherein a threshold value used by the vowel devoicing determining means for determining that the vowel devoicing process is not performed can be set by the user.

4. A speech synthesis apparatus according to claim 1, wherein a threshold value used by the vowel devoicing determining means for determining that the vowel determining process is not performed is half of a normal speech rate.

5. A speech synthesis apparatus comprising:

a text analyzer operable to generate a phonetic and prosodic symbol string from character information of an input text;

a word dictionary storing a reading and accent of a word;

a voice segment dictionary storing a phoneme that is a unit of speech;

a prosody generator operable to generate synthesizing parameters including at least a phoneme, a duration of the phoneme and a fundamental frequency for the phonetic and prosodic symbol string, the prosody generator including a vowel devoicing determining means operable to determine whether or not a vowel devoicing process is performed and a duration modifying means operable to modify the duration of the phoneme depending on a speech rate set by a user and a result of the determination by the vowel devoicing determining means, wherein the duration modifying means does not stretch the duration of the phoneme for a voiceless sound beyond a predetermined limitation value; and a waveform generator operable to generate a synthesized waveform by making waveform-overlap-adding referring to the synthesizing parameters generated by the prosody generator and the voice segment dictionary.

6. A speech synthesis apparatus according to claim 5, wherein the duration modifying means has a changeable limitation value depending on a type of the voiceless consonant.

7. A speech synthesis apparatus according to claim 5, wherein the duration modifying means has a changeable limitation value depending on a length of the phoneme stored in the voice segment dictionary.

* * * * *